US009149676B2

(12) United States Patent
Callanan

(10) Patent No.: US 9,149,676 B2
(45) Date of Patent: Oct. 6, 2015

(54) EXERCISE DEVICE

(71) Applicant: Keith Callanan, Stoughton, MA (US)

(72) Inventor: Keith Callanan, Stoughton, MA (US)

( * ) Notice: Subject to any disclaimer, the term of this patent is extended or adjusted under 35 U.S.C. 154(b) by 37 days.

(21) Appl. No.: 13/905,530

(22) Filed: May 30, 2013

(65) Prior Publication Data

US 2014/0357458 A1 Dec. 4, 2014

(51) Int. Cl.

| | |
|---|---|
| ***A63B 21/04*** | (2006.01) |
| ***A63B 21/02*** | (2006.01) |
| ***A63B 21/055*** | (2006.01) |
| ***A63B 21/00*** | (2006.01) |

(52) U.S. Cl.

CPC ..... *A63B 21/02* (2013.01); *A63B 21/0442* (2013.01); *A63B 21/0552* (2013.01); *A63B 21/0557* (2013.01); *A63B 21/1469* (2013.01)

(58) Field of Classification Search

CPC ..... A63B 19/00; A63B 19/02; A63B 19/04; A63B 21/04; A63B 21/0442; A63B 21/0435; A63B 21/0555; A63B 21/0557; A63B 21/02; A63B 21/1469

USPC ..... 482/10, 20, 21, 38–40, 44–50, 78, 92, 482/93, 100, 101, 104–108, 110, 121–130, 482/139, 904; 446/26–28, 236, 241, 246, 446/247; 16/110.1, 428, 430

See application file for complete search history.

(56) References Cited

U.S. PATENT DOCUMENTS

| | | | | |
|---|---|---|---|---|
| 605,237 | A * | 6/1898 | Spink | 482/129 |
| 1,333,005 | A * | 3/1920 | Warner | 482/110 |
| 3,131,506 | A * | 5/1964 | Fox | 446/214 |
| 3,215,429 | A | 11/1965 | Shaboo et al. | |
| 3,677,543 | A | 7/1972 | Richardson | |
| 3,708,911 | A * | 1/1973 | Haschek | 446/240 |
| 3,901,505 | A * | 8/1975 | Gerechter | 446/27 |
| 4,026,549 | A | 5/1977 | Gunn | |
| 4,540,173 | A | 9/1985 | Hopkins, Jr. | |
| 4,565,367 | A | 1/1986 | Kaiser | |
| 5,009,414 | A * | 4/1991 | Bass | 482/83 |
| 5,259,824 | A | 11/1993 | Cheltenham | |
| 5,328,433 | A | 7/1994 | Berman | |
| 5,595,559 | A | 1/1997 | Viel | |
| 5,681,243 | A * | 10/1997 | Criss | 482/49 |
| 5,709,637 | A * | 1/1998 | Gow et al. | 482/129 |
| 5,718,654 | A * | 2/1998 | Kennedy | 482/139 |
| 6,106,437 | A * | 8/2000 | Brooks | 482/10 |
| 6,450,929 | B1 | 9/2002 | Markham | |
| 6,572,483 | B1 * | 6/2003 | Hoffman | 472/118 |
| 6,966,814 | B2 * | 11/2005 | Mendel | 446/236 |
| 7,041,040 | B2 | 5/2006 | Dovner et al. | |
| 7,862,486 | B1 * | 1/2011 | Watson | 482/106 |
| 7,946,970 | B2 * | 5/2011 | Garza et al. | 482/126 |
| 8,276,351 | B1 * | 10/2012 | Henkin | 53/469 |

(Continued)

FOREIGN PATENT DOCUMENTS

| | | | |
|---|---|---|---|
| GB | 2227949 | A * | 8/1990 |
| WO | WO 9412242 | A1 * | 6/1994 |

*Primary Examiner* — Oren Ginsberg
*Assistant Examiner* — Gregory Winter
(74) *Attorney, Agent, or Firm* — Lambert & Associates; Gary E. Lambert; David J. Connaughton, Jr.

(57) ABSTRACT

An exercise device having a base that forms a ring, and at least one connection point. A resistance band is connected to the connection point, and an anchor. The base may be moved in varying directions against resistance from the resistance band to provide exercise for a user.

18 Claims, 3 Drawing Sheets

(56) References Cited

U.S. PATENT DOCUMENTS

| | | | | |
|---|---|---|---|---|
| 8,403,818 | B1 * | 3/2013 | Wilkinson et al. | 482/121 |
| 8,602,951 | B2 * | 12/2013 | Morris | 482/126 |
| 2003/0130096 | A1 * | 7/2003 | LaCroce | 482/106 |
| 2006/0211552 | A1 * | 9/2006 | Williams | 482/139 |
| 2011/0136633 | A1 * | 6/2011 | Riggs et al. | 482/121 |
| 2011/0251025 | A1 * | 10/2011 | Harker | 482/91 |
| 2013/0085046 | A1 * | 4/2013 | Jolly | 482/129 |
| 2013/0337977 | A1 * | 12/2013 | Kokenis et al. | 482/8 |

* cited by examiner

EXERCISE DEVICE

BACKGROUND OF THE INVENTION

1. Field of the Invention

The present invention relates generally to personal exercise or work-out devices. More particularly the present invention relates to an elastic based workout device capable of being used in multiple positions.

2. Description of Related Art

Today, even with added stress being placed upon physical fitness and body development, many people have found little or no time to devote to the physical fitness such as, going to the gym, or outdoor exercises such as participant sports, cycling, running, walking, etc. Many of these people have turned to mechanical devices designed to exercise the body in a multitude of ways during a short interval of use.

The exercising devices that have proven most effective and beneficial for general exercise are the well known tread mills, rowing machines and cycling machines. The primary drawback with these machines is their great expense for the average user, the large amount of floor space required for storage and use, and possible mechanical malfunction.

Further, many people do not live in homes that have space for these large indoor devices. Further still, going to the gym is not practical for many because of their busy schedules.

Therefore, what is needed is a device that may provide a full body workout in a short period of time, at a low cost and in a small space.

SUMMARY OF THE INVENTION

The subject matter of this application may involve, in some cases, interrelated products, alternative solutions to a particular problem, and/or a plurality of different uses of a single system or article.

In one aspect, an exercise device is provided. The exercise device comprises a base. The base is formed of a substantially circular or oval shaped outer ring which defines an interior aperture. A connector, or a plurality of connectors extend radially outward from an outer edge of the ring. A cross bar passes through the interior base, joining one end of the ring to the other. The exercise device further comprises a resistance strap formed of an elongate elastic strap configured to provide a resistance to movement when stretched lengthwise. The resistance strap is removably attached to the connector at a proximal end, and removably attached to an anchor at a distal end.

In another aspect, methods of using the exercise device are provided.

DETAILED DESCRIPTION

Figure 1:
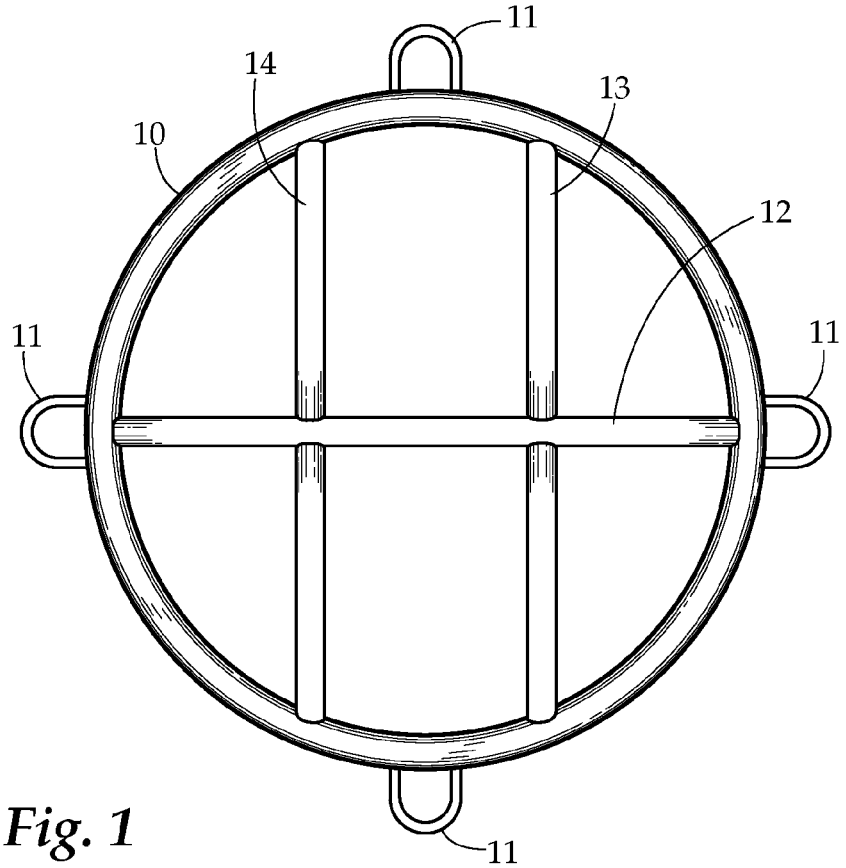
FIG. 1 provides a view of an embodiment of a base of the exercise device.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns an exercise device that utilizes a circular or oval shaped base coupled to resistance bands. The base, coupled with the resistance bands allows a full range of exercise motions including unique rotational motions not achievable with standard exercise devices. The rounded shape of the base may allow for fully natural body motions which may provide better conditioning and safety. The rotational motions facilitated by the present invention allow for better training of the body, and to help prevent injury by strengthening muscles and training proper, natural body motions.

The base of the exercise device is designed for gripping during the exercise process. The base may be circular or oval-shaped. The base outer perimeter is defined by a ring made of tubular (or similar) material. The ring is sized to be gripped by a user. This ring defines an aperture within the bounds shape defined by the tubular material. The base may be of any size, however preferably the base is sized to allow gripping by a user at approximately shoulder width apart.

Generally, the term substantially circular is used herein to describe the circular or nearly circular shape of the base. However, it should be understood that the term substantially circular is also used herein to refer to bases that are octagonal, hexagonal, rectangular, and the like.

The base may be made of any material rigid enough to maintain its shape during stresses experienced during the exercising process. Materials of which the base may be made include metals, plastics, composites, wood, and the like. The base may be made of a hollow tubular material, or may be solid.

One or a plurality of cross bars may extend across the aperture, joining portions of the ring. In one embodiment, the cross bars may be formed by the same tubular material that the ring is formed from.

In one embodiment, a cross bar may extend across a diameter of the ring, cutting the circular aperture in half, forming semi-circular or semi-oval apertures.

In another embodiment two cross bars may extend through the aperture formed by the ring to separate the aperture into three apertures, a central aperture bounded by the two cross bars and the ring, and two side apertures bounded by just one cross bar and the ring.

In still another embodiment, the base may have a first cross bar extending across a diameter of the ring, and two additional cross bars perpendicular to the first cross bar. As such, the cross bars and ring may define six apertures. These apertures may provide different places to grasp the base, which in turn provide different exercise options and variations.

The cross bars may be attached to the ring in any manner capable of attaching the two together and holding them in place against stresses during exercise. In one embodiment the cross bars may be made of tubular metal. In another embodiment, the cross bars may be formed of rigid plastic. In one embodiment, the cross bars and ring may be welded together.

The ring and/or cross bars may further comprise a connector allowing removable connection of the resistance band. The connector may be any structure particularly suited to be connected to, and capable of withstanding stresses between the ring and resistance band during an exercising process.

In one embodiment, the connector may extend radially from the ring.

In another embodiment, the connector may extend perpendicularly to the circular or oval shape defined by the ring.

In yet another embodiment, the connector may be formed by connecting (via welding, adhering, or the like) a U-bolt or similarly shaped structure to the ring, such that the connector forms an aperture defined by the connector and the ring, the resistance band being connectable to the U-shaped structure.

The number of connectors positioned on the ring may vary. In one embodiment, the ring may have a single connector. In another embodiment, the ring may have two connectors positioned opposite to each other on the ring. In still another embodiment, the ring may have four connectors positioned at 90 degrees from each other (such that for a circular ring, the connectors would be at 12, 3, 6 and 9 o'clock).

The resistance strap attachable to the base may be any elastic strap that may be elongated with the application of adequate force. The resistance straps may have a proximal end connectable to the base, and a distal end attachable to an anchor such as a wall, floor, door, doorknob, desk, heavy object, a user's limbs, or the like. In one embodiment, the proximal end of the resistance strap may be removably connectable to the connector of the base. In this embodiment, the proximal end may be attached to any of the connectors, depending on the desired exercises and activities desired by the user.

In one embodiment, the strap may form a 'Y' Shape, such that it has two proximal ends, and a single distal end.

In another embodiment, two or more separate straps may be used.

The resistance strap or straps may be connected to the connector of the base in any manner such as tying, clipping, hooking, and the like. In one embodiment, the proximal end of the strap comprises a bar, such as a handle bar, with flexible connectors joining the bar to the remainder of the strap. In this embodiment, the bar and connector act similar to a toggle and loop connection, such that attachment is achieved by passing the handle bar lengthwise through an aperture formed by the connector, and then rotating the handle bar such that it is substantially widthwise with relation to the aperture. The width of the handle bar is greater than the size of the aperture, and cannot pass through. This configuration may be particularly applicable to base embodiments having a U-shaped or similar connector.

In one embodiment, a plurality of straps may be provided each having a different resistance to elongation. As such, a user may select greater or less resistance depending on the exercise being performed and training level. Further, two or more resistance bands may be attached to the base, either to the same connector or different connectors, to increase the overall resistance provided by the bands.

In one embodiment, the strap may have an outer covering that may cover an interior elastic material. The outer covering may be flexible itself to stretch with the strap, or may be non-flexible and be bunched up when the strap is at a resting (contracted) position.

The distal end of the strap may comprise a loop, hook or other structure to allow it to easily be attached to the solid object. For example, a loop may allow the strap to be connected to a doorknob, or wrapped about a leg of a table by forming a slip knot.

The exercise device described herein provides a number of advantages over the prior art. In particular, embodiments having circular or oval shaped bases provide natural and ergonomic exercise positions and motions, resulting in optimal exercise results. Further, optimized grasping of the base and natural exercise motions limit injury, and allow muscles under strain to provide maximum output.

The base and strap exercise device may be used in any number of ways. Exercise motions may include, but are not limited to: overhead pushing, pulling the base toward the body (using hands or feet), pushing the base from the body (using hands or feet, and rotating the base either about the body or about itself. This pushing and pulling may be performed at any angle and may employ any number of different muscle groups. A user may hold, hook, grasp or otherwise connect to the base in any manner capable by the human anatomy. Examples of ways to connect to the base by the user may include holding with a user's hands or feet, or hooking feet, arms, shoulders, legs, hips, and the like, around the ring or cross bars or bracing the base flat against a users back or chest. Further, the device may be used as a therapeutic device. For example, the device may be used to enhance stabilization for the core muscles, shoulders, and the like.

A safety mechanism may be employed to prevent the device from being uncontrollably drawn away from a user. The safety mechanism may be a Velcro® or similar wrist, ankle, foot, or other body connection between the base and the user. As such, if the user loses a grip of the base, it will not be able to be drawn too far away from the user's body.

Turning now to FIG. 1, an embodiment of the base is shown. The base is formed as a substantially circular ring 10. Four U-shaped connectors 11 are attached at 90 degree angles (i.e. 12 o'clock; 3 o'clock; 6 o'clock; and 9 o'clock) about the ring 10. The connectors may be used to attach one or more resistance straps (not shown) to the base. A first cross bar 12 extends across a diameter of the ring 10. A second and third cross bar 13, 14 extend perpendicularly to the first cross bar across the ring 10. As such, the first, second, and third cross bars 12, 13, 14, along with the ring 10, form six different apertures through which a user may grasp, hold, or otherwise connect to the base.

Figure 2:
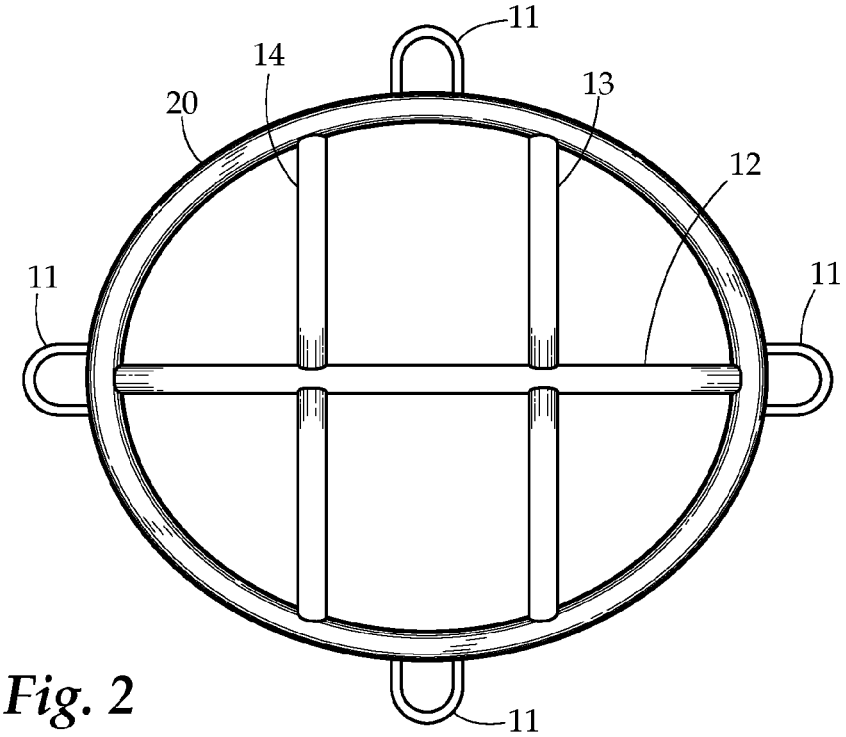
FIG. 2 provides a view of an embodiment of a base of the exercise device.

FIG. 2 shows another embodiment of the base. The base is shaped as a substantially oval shaped ring 20. Four U-shaped connectors 11 are attached at 90 degree angles about the ring 10. The connectors may be used to attach one or more resistance straps (not shown) to the base. A first cross bar 12 extends across a center of the ring 10. A second and third cross bar 13, 14 extend perpendicularly to the first cross bar across the ring 10. As such, the first, second, and third cross bars 12, 13, 14, along with the ring 10, form six different apertures through which a user may grasp, hold, or otherwise connect to the base.

Figure 3:
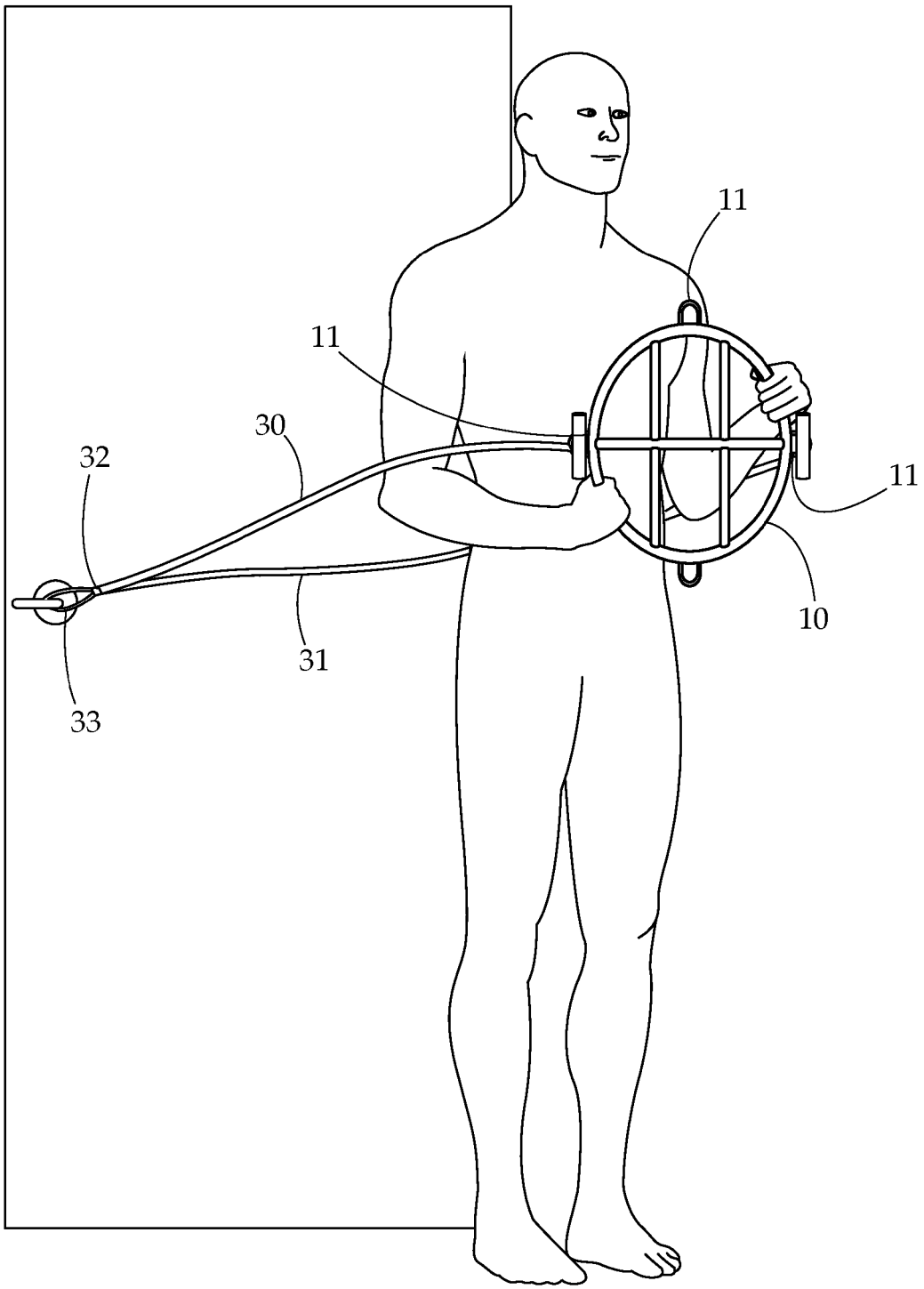
FIG. 3 provides a view of an embodiment of the exercise device in use.

FIG. 3 provides an embodiment of the exercise device in use. In this embodiment, a user is holding the base ring 10 with his hands, and pushing the ring away from his body. It should be understood from this position, that any number of twisting, pushing and rotating exercises are possible, and encouraged. Two resistance straps 30 and 31 are attached to the base ring 10 by connectors 11. The resistance straps 30, 31 are attached to opposite sides of the base ring 10. The straps 30, 31 are joined together at connection point 32, such that they combine to form a single distal end 33. The single distal end 33 is attached to a doorknob of a closed door, which acts as an anchor to which the resistance bands 30,31 may be secured.

Figure 4:
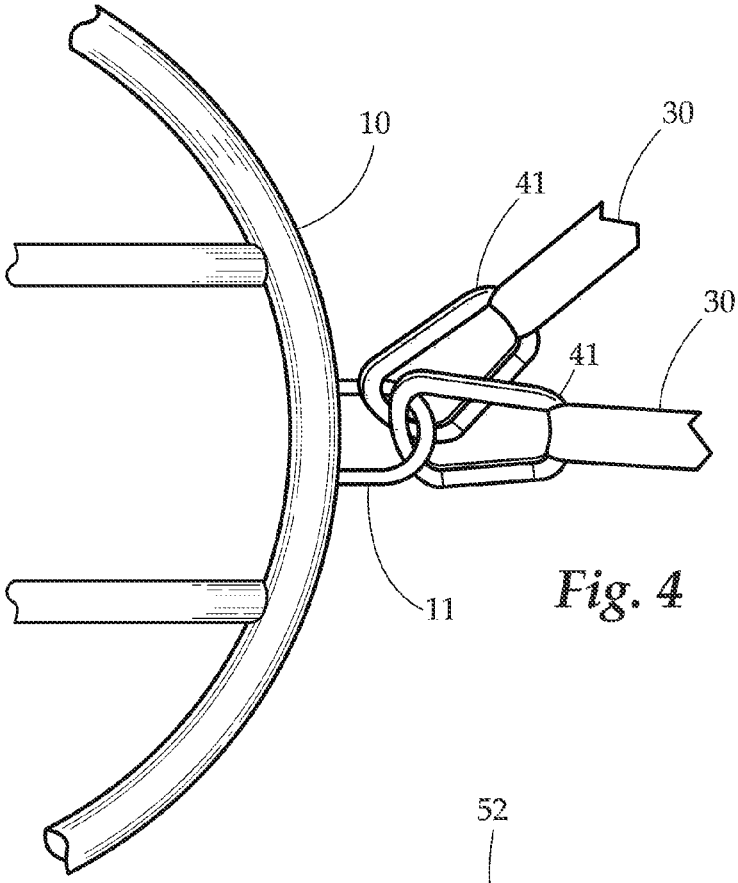
FIG. 4 provides a detail view of an embodiment of a connection between the base and resistance band.

FIG. 4 provides a detail view of an embodiment of connection of a resistance strap to the ring. The resistance band 30 has a latching hook 41 such as a carabiner at its end. This latching hook 41 is hooked to a connector 11 protruding from the ring 10. The latching hook 41 may be easily unhooked and detached from the connector 11. However, as noted throughout, the hook 41 may be replaced with any similar connecting device such as a fabric loop, slip knot, toggle and loop connector, and the like.

Figure 5:
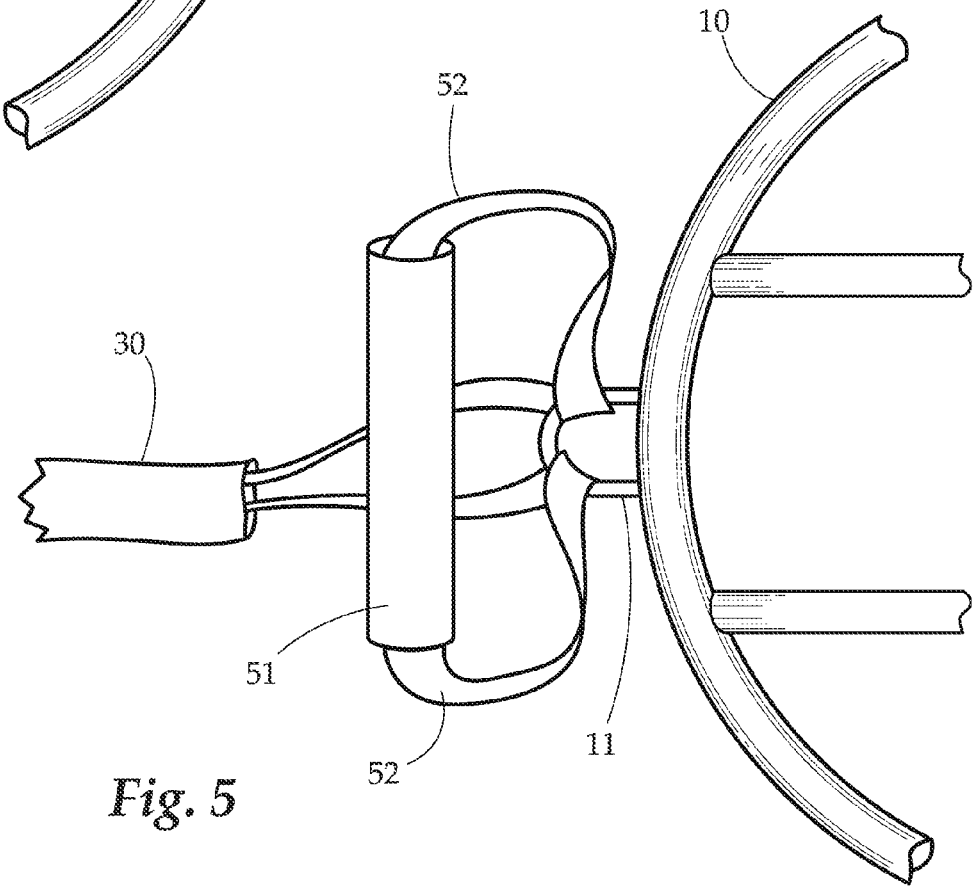
FIG. 5 provides a detail view of an embodiment of a connection between the base and resistance band.

FIG. 5 provides a detail view of another embodiment of connection of a resistance strap to the ring. The end of the resistance strap 30 has a bar 51 attached to it by two straps 52. This 51 bar is positioned perpendicularly to the aperture formed by the connector 11, and thus secured to the ring 10. To remove the bar 51, it may be rotated such that its length is parallel to the aperture of the connector 11, the bar 51 may then be passed through the aperture.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. An exercise device comprising:

a base, the base comprising:

a circular outer ring defining an interior aperture;

a connector extending radially outwardly from an outer edge of the ring;

a cross bar passing through the interior aperture formed by the ring, each end of the cross bar fixedly connected to the ring and being non-movable with respect to the ring;

a second cross bar oriented perpendicularly to the cross bar, each end of the second cross bar fixedly connected to the ring and being non-movable with respect to the ring; and a resistance strap, the resistance strap comprising an elongate elastic strap configured to provide a resistance to movement when stretched lengthwise, the resistance strap removably attached to the connector at a proximal end via a connecting device allowing removable attachment, the connecting device being at least one of a fabric loop, slip knot, toggle and loop connector, hook, and latching hook, the resistance strap removably attached to a fixed position anchor at a distal end.

2. The exercise device of claim 1 further comprising a plurality of resistance straps, a proximal end of each of the plurality of resistance straps removably attached to the connector.

3. The exercise device of claim 1 further comprising:

a plurality of resistance straps;

a plurality of connectors extending radially outward from the outer edge of the ring; and wherein each of the plurality of resistance straps has a proximal end removably attached to a different one of the plurality of connectors.

4. The exercise device of claim 1 wherein the base further comprises a third cross bar oriented perpendicularly to the cross bar, each end of the third cross bar connected to the ring.

5. The exercise device of claim 4 wherein the cross bar, the second cross bar, the third cross bar, and the ring form six apertures.

6. The exercise device of claim 1 wherein the resistance strap splits along its length such that it forms two proximal ends, and a single distal end;

wherein the base further comprises a second connector extending radially from the outer edge of the ring; and wherein a first of the two proximal ends is removably attached to the connector, and a second of the two proximal ends is removably attached to the second connector.

7. The exercise device of claim 1 wherein the connector forms a U-shaped protrusion and defines a connection aperture, the proximal end of the resistance strap being attached to the U-shaped protrusion.

8. The exercise device of claim 1 further comprising a plurality of resistance straps, a first of the plurality of resistance straps having a first resistance, and a second of the plurality of resistance straps having a second, different resistance, one of the plurality of resistance straps being removably attached to the connector.

9. The exercise device of claim 1 wherein the distal end of the resistance strap further comprises a loop.

10. An exercise device comprising:

a base, the base comprising:

an oval shaped outer ring defining an interior aperture;

a connector extending radially outwardly from an outer edge of the ring;

a cross bar passing through the interior aperture formed by the ring, each end of the cross bar fixedly connected to the ring and being non-movable with respect to the ring;

a second cross bar oriented perpendicularly to the cross bar, each end of the second cross bar fixedly connected to the ring and being non-movable with respect to the ring; and a resistance strap, the resistance strap stretchable in a lengthwise direction and comprising an elongate elastic strap configured to provide a resistance to movement when stretched lengthwise, the resistance strap removably attached to the connector at a proximal end via a connecting device allowing removable attachment, the connecting device being at least one of a fabric loop, slip knot, toggle and loop connector, hook, and latching hook, the resistance strap removably attached to a fixed position anchor at a distal end.

11. The exercise device of claim 10 further comprising a plurality of resistance straps, each of the plurality of resistance straps having a proximal end removably attached to the connector.

12. The exercise device of claim 10 further comprising:

a plurality of resistance straps;

a plurality of connectors extending radially outward from the outer edge of the ring; and wherein each of the plurality of resistance straps has a proximal end removably attached to a different one of the plurality of connectors.

13. The exercise device of claim 10 wherein the base further comprises a third cross bar oriented perpendicularly to the cross bar, each end of the third cross bar connected to the ring.

14. The exercise device of claim 13 wherein the cross bar, the second cross bar, the third cross bar, and the ring form six apertures.

15. The exercise device of claim 10 wherein the resistance strap splits along its length such that it forms two proximal ends, and a single distal end;

wherein the base further comprises a second connector extending radially from the outer edge of the ring; and wherein a first of the two proximal ends is removably attached to the connector, and a second of the two proximal ends is removably attached to the second connector.

16. The exercise device of claim 10 wherein the connector forms a U-shaped protrusion and defines a connection aperture, the proximal end of the resistance strap being attached to the U-shaped protrusion.

17. The exercise device of claim 10 further comprising a plurality of resistance straps, a first of the plurality of resistance straps having a first resistance, and a second of the plurality of resistance straps having a second, different resistance, one of the plurality of resistance straps being removably attached to the connector.

18. An exercise device comprising:

a base, the base comprising:

a circular outer ring defining an interior aperture;

a plurality of connectors extending radially outwardly from an outer edge of the ring;

a first cross bar passing through the interior aperture formed by the ring, each end of the first cross bar connected to the ring;

a second cross bar oriented perpendicularly to the first cross bar, and passing through the cross bar, each end of the second cross bar connected to the ring;

a third cross bar oriented perpendicularly to the first cross bar, and passing through the cross bar, each end of the third cross bar connected to the ring;

a plurality of resistance straps, the plurality of resistance straps each comprising an elongate elastic strap configured to provide a resistance to movement when stretched lengthwise, each of the plurality of resistance straps removably attached to one of the plurality of connectors at a proximal end, and removably attached to an anchor at a distal end;

wherein each of the plurality of connectors forms a U-shaped protrusion and defines a connection aperture; and wherein a proximal end of each of the plurality of resistance straps comprises a handle, the handle attaching to the U-shaped connector as a toggle and loop connection.

* * * * *